United States Patent [19]

Kimzey et al.

[11] 4,320,556

[45] Mar. 23, 1982

[54] SURFACE MAINTENANCE EQUIPMENT

[75] Inventors: Paul W. Kimzey, St. Louis Park; John L. Hanna, Deephaven, both of Minn.

[73] Assignee: Tennant Company, Minneapolis, Minn.

[21] Appl. No.: 186,705

[22] Filed: Sep. 12, 1980

[51] Int. Cl.[3] ..... A47L 5/12

[52] U.S. Cl. ..... 15/347; 15/340; 15/346

[58] Field of Search ..... 15/340, 346, 347, 348, 15/349

[56] References Cited

U.S. PATENT DOCUMENTS

| | | | |
|---|---|---|---|
| 3,837,038 | 9/1974 | Kimzey et al. | 15/349 |
| 3,881,215 | 5/1975 | Krier et al. | 15/340 |
| 3,938,217 | 2/1976 | Hommes | 15/346 |
| 4,037,290 | 7/1977 | Rose et al. | 15/340 X |
| 4,110,864 | 9/1978 | Gunnarson | 15/346 X |

*Primary Examiner*—Chris K. Moore

*Attorney, Agent, or Firm*—Norman P. Friederichs

[57] ABSTRACT

The present invention provides surface maintenance equipment, such as for sweeping lawns, such equipment including a skirt structure for the debris pickup housing.

8 Claims, 3 Drawing Figures

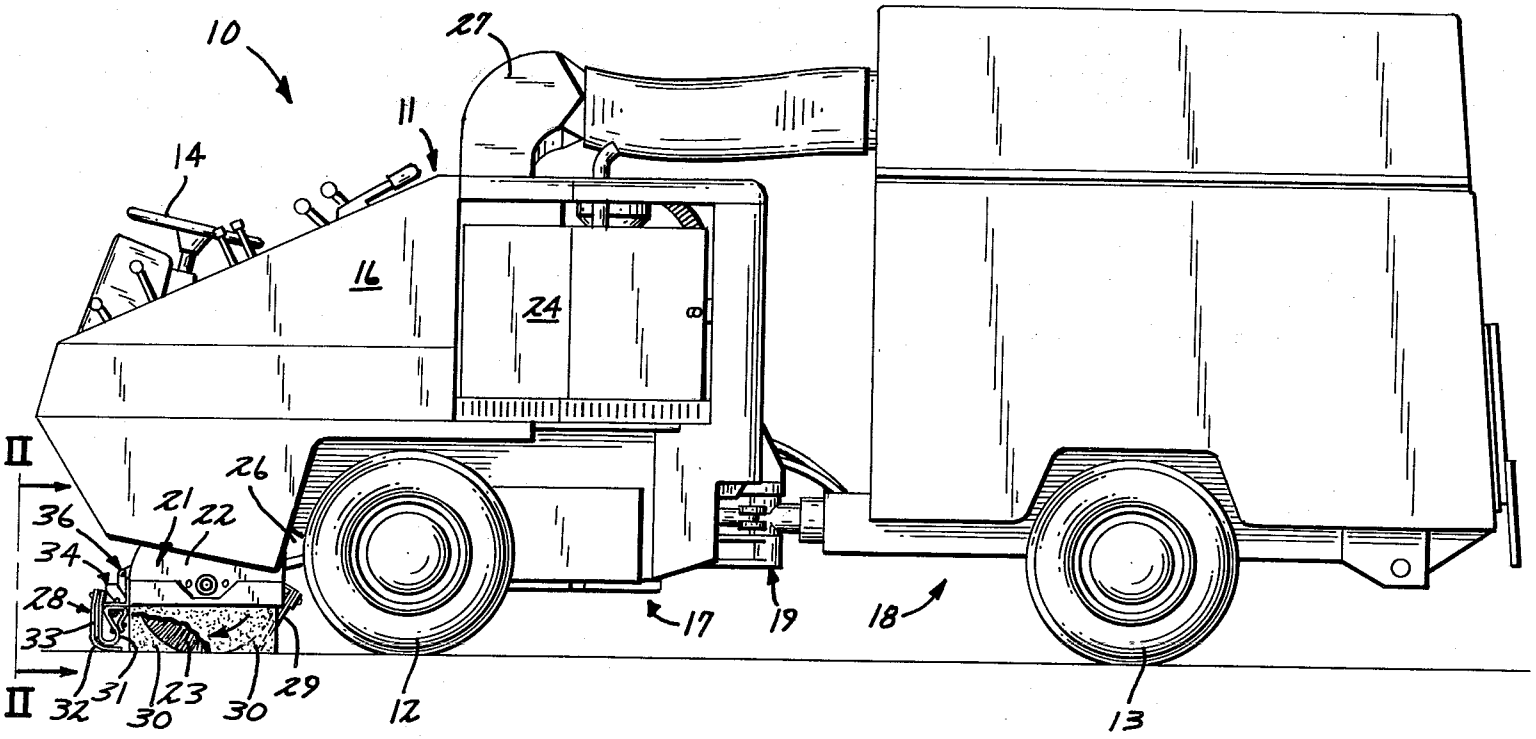
FIG. I

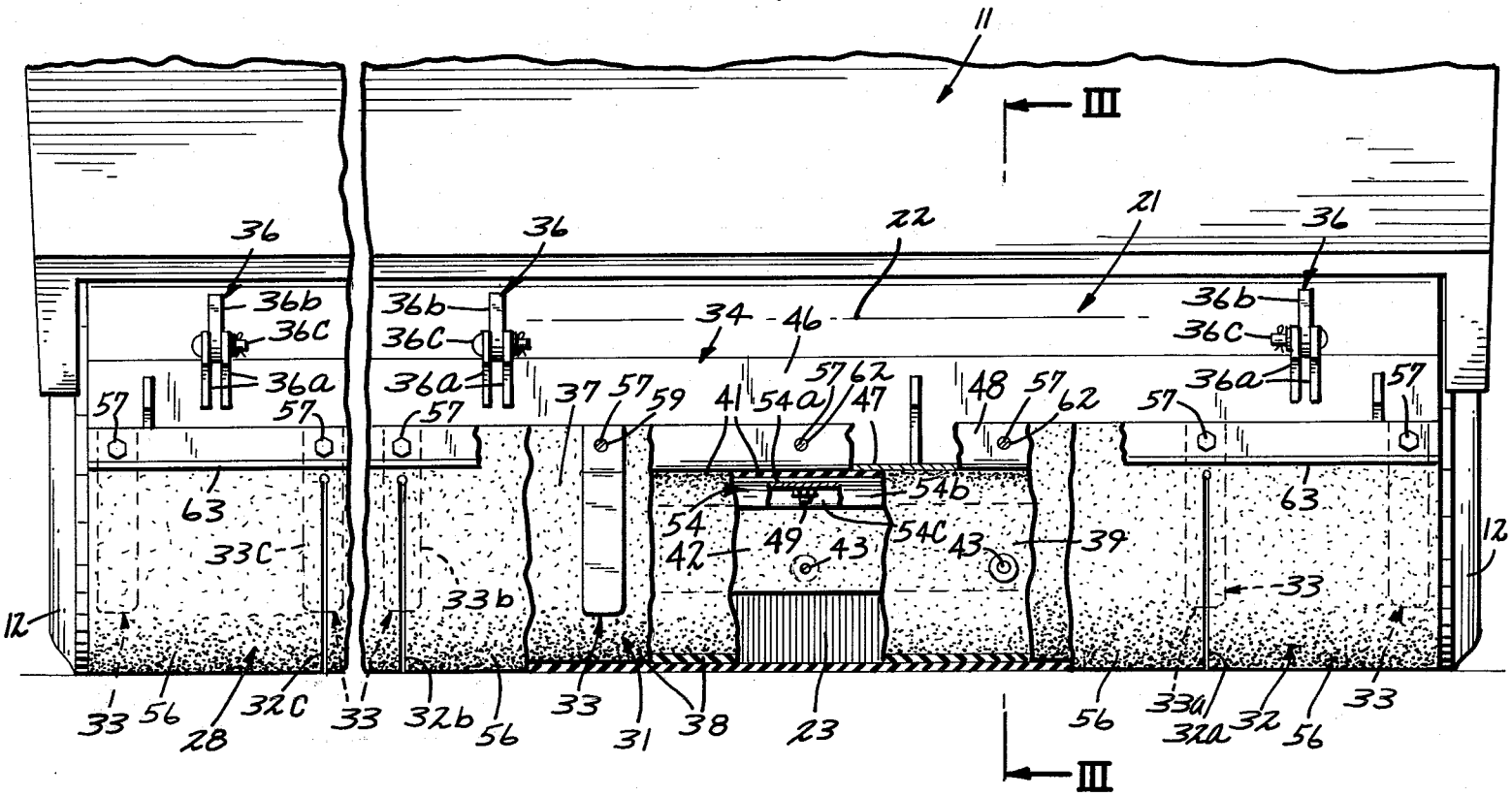
FIG. II

FIG. III
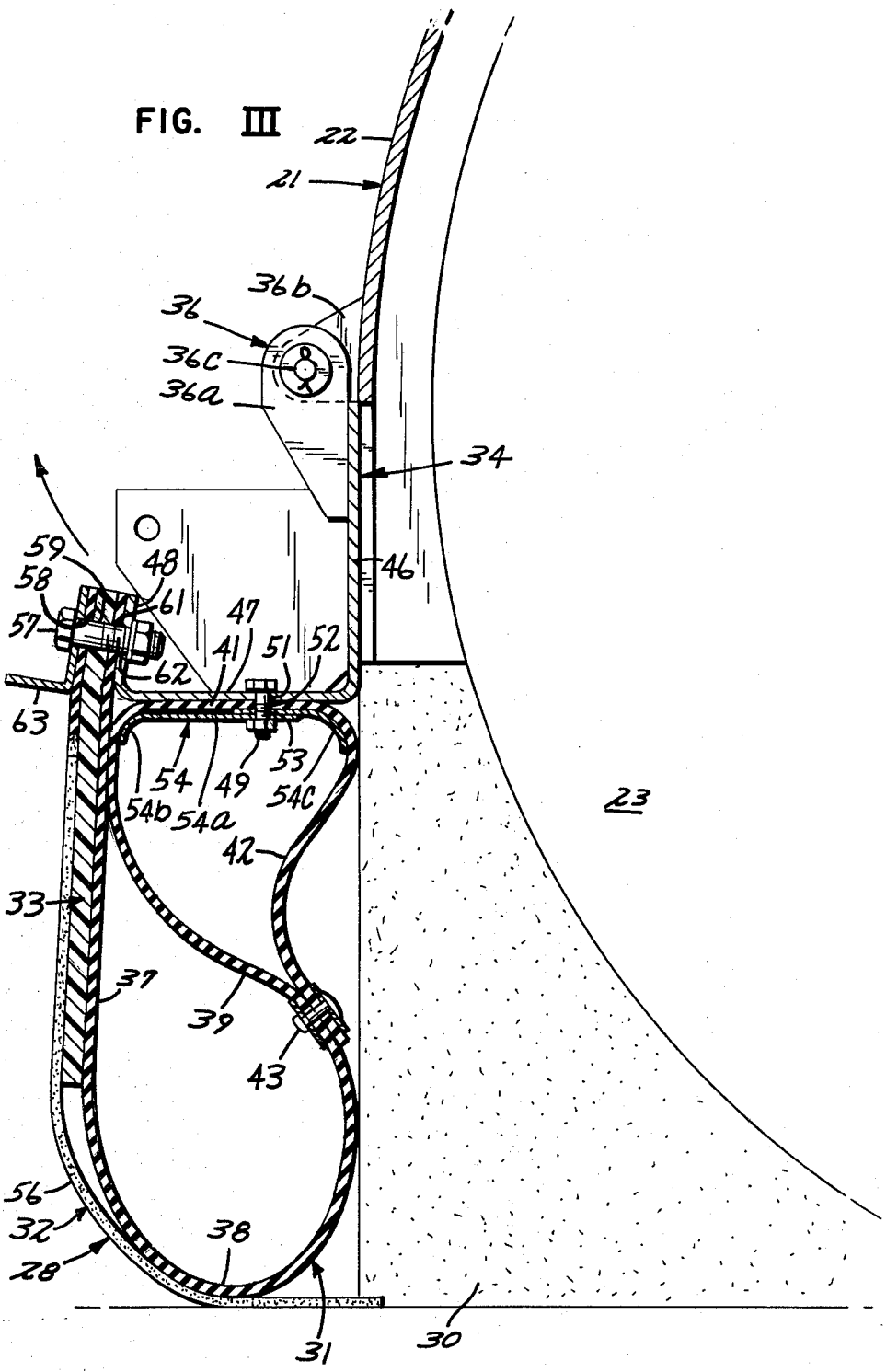

SURFACE MAINTENANCE EQUIPMENT

TECHNICAL FIELD

The present invention relates to surface maintenance equipment such as sweepers and more particularly surface maintenance equipment that may be used in sweeping outdoors in areas such as lawns and parking lots.

BACKGROUND OF THE INVENTION

Surface maintenance equipment is available in a wide variety of types and sizes. Certain of such equipment is designed for indoor use while other equipment is particularly adapted for use in caring for large outdoor areas such as parks, parking lots and the like. The present invention is generally of the latter type, although it may be used in any desired area.

Surface maintenance equipment typically has included a body portion supported on a plurality of wheels. The equipment will include a power source such as a gasoline engine or an electric motor. The power source drives certain of the wheels as well as driving vacuum equipment. The body usually will carry a hopper for containment of dirt and debris which has been picked up. In some instances the equipment will be an articulated structure including a cab portion and a trailer portion. The equipment generally has a debris pickup housing which defines a zone from which the dirt and debris is lifted and deposited in the hopper. A rotatably driven cylindrical tool, typically a brush or a paddle structure, may be disposed in the pickup housing to assist in lifting the dirt and debris. A duct may provide communication between the debris pickup housing and the hopper. Such surface maintenance equipment of course also includes various controls such as steering mechanisms, speed controls and the like. The general type of equipment contemplated in the present invention is illustrated in U.S. Pat. Nos. 3,837,038 (Kimzey) and 3,881,215 (Krier et al.), which are assigned to Tennant Company. This type of equipment will generally include a flexible skirt structure around the lower periphery of the debris pickup housing. The flexible skirt structure assists in providing a partial seal between such housing and the surface being swept. The skirt further aids in dust control and minimizes undesirable projection of debris. The skirt also permits upward spacing of metal parts of the housing to prevent damage from undulations in the surfaces, large pieces of debris, and the like.

It is important for efficient operation of sweeping equipment that the skirt structure maintain the partial seal. Problems have been encountered in some instances wherein the skirt structure is pulled up out of engagement with the surface and, for example, becomes caught by the rotating cylindrical tool and lifted to a position where the skirt is inoperative. This problem is particularly apparent in those instances where the cylindrical tool rotates with sweeping being in a forward direction.

SUMMARY OF THE INVENTION

The present invention relates to surface maintenance equipment including a body structure supported on a plurality of wheels. The equipment has a vacuumized debris pickup housing and may include duct work extending from the housing to a storage area or hopper. The rotatable tool may be a brush or paddle device and is carried in the debris pickup housing to assist in lifting the debris into the hopper. The tool may be either floating or supported in the housing. A skirt structure provides a seal around the lower edge of the debris pickup housing. At least a portion of the skirt structure may comprise a stabilizing member and a vertically oriented skirt overlying the stabilizing member. The stabilizing member may be of sheet material so disposed as to have a cross-section which is substantially a closed S-shape. The stabilizing member serves to urge the skirt into sealing engagement with the surface and assure that the skirt does not become entrapped by the rotating tool. The stabilizing member provides a surface for the brush to sweep debris against as the debris moves upwardly in the housing.

BRIEF DESCRIPTION OF THE DRAWINGS

In the drawings:

FIG. I is a left side view of surface maintenance equipment according to the present invention;

FIG. II is a front view of a portion of the present invention taken along the line II—II in FIG. I, with sections broken away to expose underlying structure;

FIG. III is a sectional view taken along the line III—III in FIG. II.

DETAILED DESCRIPTION OF THE PRESENT INVENTION

The surface maintenance equipment 10 of the present invention, one embodiment of which is illustrated in FIGS. I–III may include a body structure 11, which is supported on a plurality of wheels 12 and 13. Wheels 12 may be steerable such as by suitable movement of the steering wheel 14 to control the direction traversed by the equipment 10. The wheels 12 may also be driven by a suitable motor or engine 16. In the particular equipment shown in FIG. I, the unit is articulated and includes a tractor portion 17 and trailer portion 18 which are interconnected by a trunion joint 19. Equipment 10 has a pickup assembly 21 including a pickup housing 22 and a rotatably driven pickup tool 23. The pickup tool 23 may be a cylindrical brush or it may be a paddle structure. The pickup housing 22 may be connected to a fan 24 by a duct 26. The fan 24 may in turn be connected to the trailer 18 by a duct 27.

The pickup housing 22 may include a metal-walled housing structure which is downwardly opening and has a plurality of resilient skirts such as 28, 29, and 30 around a periphery thereof. The skirts 28, 29, and 30 provide a partial seal between the housing 22 and the surface being cleaned. The rotary tool 23, may be driven by motor 16 such as through a chain and sprocket assembly. Alternatively, tool 23 may be driven by a direct drive motor. The fan 24 may vacuumize the housing 22 and duct 26 to lift debris which is lying on the surface over which the housing 22 passes. The vacuum assists in dust control. The fan 24 further serves to project debris under a positive air pressure through duct 27 and into the hopper 20 provided by trailer 18.

The skirt structure 28 (FIG. III) includes a stabilizing member 31, a vertically oriented skirt 32 and a plurality of spaced finger-like members 33. The skirt structure 28 may extend substantially across the forward edge of the housing 22 and is mounted on a pivotable bracket 34. The bracket 34 may be supported on a clevis and ear arrangement 36. Clevis and ear structures may be provided at spaced locations across the skirt structure 28 as seen in FIG. II. The skirt structure 28 may be manually lifted to admit debris therebeneath.

The stabilizing member 31 may be formed of a sheet of resilient material such as a rubber-like material which may be fabric reinforced. The sheet is formed so as to provide a cross section with a substantially closed S-shape. The stabilizing member 31 has a vertically extending wall 37, a lower arcuate wall section 38, an upwardly extending diagonal wall section 39, an upper arcuate wall section 41, and a downwardly extending wall section 42. The lower portion of wall 42 lies parallel to the adjacent portion of wall 39 and is secured thereto such as by a plurality of spaced rivets 43.

The stabilizing member 31 is supported on bracket 34. Bracket 34 may be a channel member having an upstanding portion 46 and a horizontal, outwardly extending portion 47. Portion 47 may be at right angles to portion 46 and may be intergral therewith. Bracket 34 further includes a forwardly upstanding portion 48 which is integral with portion 47. The clevis members **36*a* may be secured to bracket 46 such as by welding and are spaced sufficiently to permit lodgement of the ear 36*b* therebetween. Ear 36*b* may be welded to housing 22. A pin and key 36*c* pivotably secures the clevis 36*a* to the ear 36*b***.

The stabilizing member 31 is secured to the bracket 34 by a plurality of bolts 49 spaced along the length of bracket portion 47. The bolt 49 extends through an opening 51 in bracket portion 47, opening 52 in stabilizing member wall 41 and through an opening 53 in a support bar 54. The support bar 54 extends along the full length of bracket 34. The support 54 may be of a light gauge metal and includes a flat center wall portion **54*a* and an arcuate portion 54*b* and 54*c* along each edge. The portions 54*b* and 54*c* tend to protect the adjacent portions of stabilizing member 31. The bar 54 acts to support the stabilizing member 31 tightly against the bracket 34**.

The skirt 32 (FIG. II) extends substantially across the entire front portion of pickup housing 22 and has a somewhat greater vertical dimension than the stabilizing member 31. The skirt 32 may be formed of a sheet of resilient rubber-like material which may include fabric reinforcement. The skirt 32 may have a plurality of slits such as **32*a*, 32*b* and 32*c* to provide a plurality of free moving panels 56. Each panel may independently move upwardly when encountering a large piece of debris, thus facilitating a more efficient vacuum. A plurality of finger-like structures 33*a*, 33*b*, and 33*c* of thicker resilient material are disposed between the skirt 32 and stabilizing member 31, adjacent each edge of the panels 56. For example, finger 33*a* is disposed immediately behind the slit 32*a* so as to provide support for the adjacent portions of skirt 32. Similar fingers are provided adjacent the other slits in skirt 32. For example, finger 33*b* which lies behind slit 32*b*, finger 33*c* which lies behind slit 32*c*. The fingers assist in vacuum sealing along the slits 32 and return of panels 56** to proper location after large debris passes therebeneath.

Support is provided for the forward portions of skirt assembly 28 by a plurality of openings 58 spaced along the upper forward parts thereof. For example, bolt 57 extends through an opening 58 in skirt 32, opening 59 in finger 33, opening 61 in stabilizing wall 37 and opening 62 in portion 48 of bracket 34. A bar 63 may overlie the skirt 32 to provide a more durable support.

OPERATION OF THE INVENTION

In many respects the operation of the present invention will be similar to that of the cleaning apparatus shown in U.S. Pat. Nos. 3,837,038 and 3,881,215 (assigned to Tennant Company). The difference between the present invention and those in the patents being in the structure and operation of the stabilizing member of the front skirt. The sealing skirt structure of U.S. Pat. No. 3,881,215 (Krier et al) includes a pair of loops which are disposed behind a resilient sheet-like skirt.

The apparatus 10 of the present invention may be placed in operation by starting the engine or switching on the electric motor and moving the unit to the location where the surface is to be cleaned. Controls are then manipulated to lower the housing 22 and cylindrical tool 23 into operating position. The rotary tool is driven in a clockwise direction as viewed in FIG. I and illustrated by the arrow. Debris, grass and the like are picked up, swept vertically along stabilizing member 31, carried through the duct 26, through fan 24 and blown through duct 27 into the hopper 20 provided by trailer 18. The fan 24 vacuumizes the housing 22 to assist the lifting and carriage of the debris through duct 26. The skirts 28, 29, and 30 assist in providing a partial seal thus facilitating the vacuumizing of housing 22. When the tool 23 is lowered into operating position, the stabilizing member 31 approaches the surface as illustrated in FIG. III. The skirt 32 then lies along beneath the stabilizing member 31. The stabilizing member 31 assures that the skirt 32 does not become engaged with the rotary tool 23 and drawn upwardly out of engagement with the surface being cleaned when a larger piece of debris is encountered. Absent the stabilizing member 31 the large debris may push skirt 32 rearwardly and upwardly into tool 23. The particular configuration of the stabilizing member 31 is of importance. It has been found that the substantially closed S-shaped configuration of stabilizing member 31 facilitates better control of the skirt 32 and assures return of skirt 32 to proper operating position downwardly and forwardly after large debris has passed therebeneath.

What is claimed is:

1. Surface maintenance equipment comprising:

body structure and a plurality of wheels supporting said body structure, said body structure including a hopper, a downwardly opening housing defining a debris pickup chamber, and means for conveying debris from said pickup chamber to said hopper, said pickup housing including downwardly extending skirt means for partially sealing around the perimeter of said pickup chamber, at least a portion of said skirt means comprising in cross-section a substantially closed S-shaped stabilizing member and a vertically oriented skirt overlying said stabilizing member, said stabilizing member and skirt being comprised of a resilient material, whereby said stabilizing member resiliently urges said skirt into sealing engagement with the surface being maintained.

2. The surface maintenance equipment of claim 1 wherein the stabilizing member and vertically oriented skirt combination are provided along the forward edge of said pickup housing.

3. The surface maintenance equipment of claim 2 wherein a plurality of thickened vertically oriented resilient fingers are disposed between and spaced along said stabilizing member and skirt, said fingers serving to assist in urging said skirt toward a sealing position.

4. The surface maintenance equipment of claim 3 wherein said pickup housing includes an upwardly and forwardly pivotable bracket for supporting said stabilizing member and skirt.

5. The surface maintenance equipment of claim 2 wherein said pickup housing includes an upwardly and forwardly pivotable bracket for supporting said stabilizing member vertically oriented lip.

6. Surface cleaning apparatus comprising:

body means supported on a plurality of wheels, a hopper and a vacuum fan carried by said body means, power means for driving said wheels and said vacuum fan, a downwardly opening housing defining a sweeping chamber, said housing being supported by said body means and communicating with said hopper, said vacuum fan acting to vacuumize said housing, said housing having sealing skirt assemblies around the periphery thereof, the skirt assembly disposed along the forward side of said housing comprising a vertically disposed resilient sheet providing a skirt and a stabilizing member disposed behind said sheet, said stabilizing member comprising in cross-section a forward vertical wall portion, and integral lower arcuate wall portion, an integral diagonal wall portion, an integral upper arcuate wall portion and an integral depending wall portion.

7. The apparatus of claim 6 wherein the lower end of said depending wall portion lies adjacent and parallel with the lower portion of said diagonal wall portion, said lower end being secured to said diagonal portion.

8. Surface maintenance equipment comprising:

body structure and a plurality of wheels supporting said body structure, said body structure including a hopper, a downwardly opening housing defining a debris pickup chamber, and means for conveying debris from said pickup chamber to said hopper, said pickup housing including downwardly extending skirt means for partially sealing around the perimeter of said pickup chamber, at least a portion of said skirt means comprising in cross-section a substantially closed S-shaped member, said member being a resilient material, whereby said member provides sealing engagement with the surface being maintained.

* * * * *